United States Patent [19]

Osika

[11] 4,356,368

[45] Oct. 26, 1982

[54] AUXILIARY SWITCH ASSEMBLY FOR A POWER CONTACTOR

[75] Inventor: Thomas F. Osika, Valparaiso, Ind.

[73] Assignee: McGill Manufacturing Company, Inc., Valparaiso, Ind.

[21] Appl. No.: 145,804

[22] Filed: May 1, 1980

[51] Int. Cl.[3] ..... H01H 45/02; H01H 45/08

[52] U.S. Cl. ..... 200/307; 200/153 T; 335/132

[58] Field of Search ..... 335/132; 200/307, 293, 200/308, 338, 153 T

[56] References Cited

U.S. PATENT DOCUMENTS 2,874,245 2/1959 Moyer ..... 335/131
2,924,685 2/1960 Burch ..... 335/132
3,354,415 11/1967 Gribble et al. ..... 335/132
3,435,389 3/1969 Mikolic et al. ..... 200/153 LB
3,821,503 6/1974 Homan et al. ..... 200/293

*Primary Examiner*—John W. Shepperd
*Attorney, Agent, or Firm*—Foorman L. Mueller

[57] ABSTRACT

An auxiliary switch assembly for mounting on and operation by a power contactor includes a molded plastic housing cover to be mounted on the contactor by screws which provides a space within the housing for two electrical switches, which for this assembly are standard snap-action switches, and space for a movable element mechanically connected to the actuator of the power contactor which moves within the confines of the housing cover to engage the plunger in each such switch.

5 Claims, 6 Drawing Figures

FIG. 3
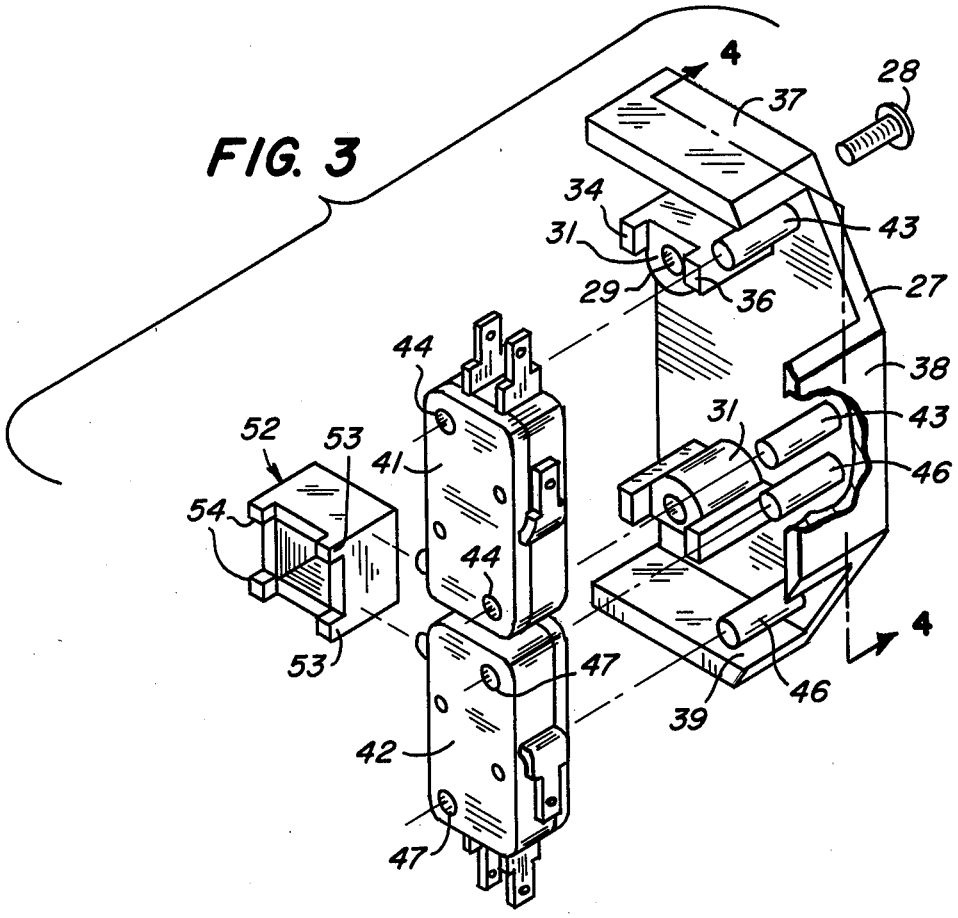
FIG. 4
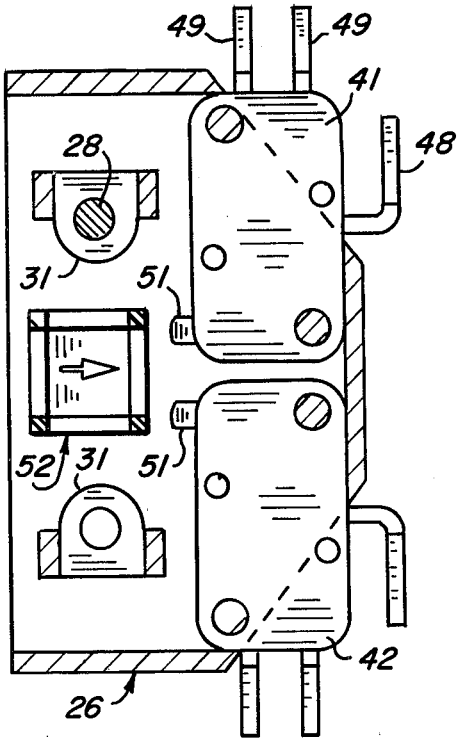
FIG. 5
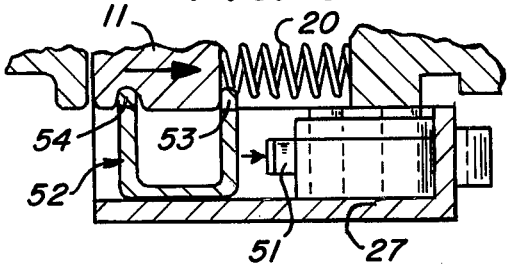
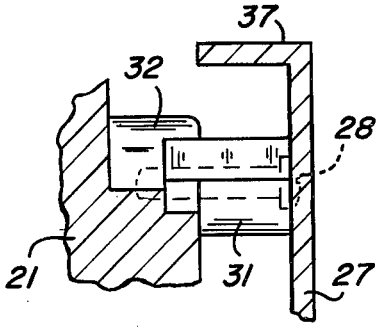
FIG. 6

AUXILIARY SWITCH ASSEMBLY FOR A POWER CONTACTOR

BACKGROUND OF THE INVENTION

This invention relates generally to an auxiliary switch assembly for electrical circuit switching complementary to the operation of a power contactor, and specifically to a package for one or two switches to be mounted on a power contactor and operable by the actuator of the power contactor itself so that any circuit or circuits through the switch or switches of such package are timed with the operation of a circuit or circuits through the contactor, but are normally electrically independent of the circuitry through the contactor.

Power contactors are used to switch lighting systems on and off, transformers, capacitors, and other heavy or relatively heavy non-motor loads, as well as handling heavy motor circuits, and the like. For instance, a power contactor or more than one power contactor may be used in an electrical control panel to control a heavy electrical load at high voltages, and supplementary or complementary circuits operating on 120 volts may be required for operating indicating lights, meters, and the like whose operation is to be correlated with that of the circuitry for the heavy load through the power contactor. It is conventional to have auxiliary units for complementary lower voltage operation mounted on such power contactors, but those of the prior art have been generally tailored to a specific contactor and employing correspondingly special switches and packaging which has added to the cost of the structure without any particular benefit to the operation of the power contactor from that special designing and added cost.

SUMMARY OF THE INVENTION

It is an object of the present auxiliary switch assembly to provide a simple rugged housing readily adapted for mounting on a power contactor and utilizing in such assembly on the contactor a standard electrical switch for conventional mechanical operation by the acutator of such contactor to in turn control a circuit which is independent of the circuit through the contactor.

Another object of such invention is to provide such simplicity and ruggedness in the structure, and provide ease of operation in an auxiliary switch unit for a power contactor that is low in cost, and which uses a standard switch or switches to reduce the initial assembly cost, and to make any subsequent repair of the switch element of such unit easy and inexpensive.

A still further object of the invention is to provice complementary electrical switching structure for a power contactor which will accommodate and operate on said contactor with one, two, three or four switches, as desired.

In a preferred embodiment of the invention the complementary structure comprises a molded plastic housing as a cover that may be mounted on the side wall of a power contactor over the contactor actuator and utilizing that side wall as one side of such housing. The mounted cover with side wall portions traps within the resulting housing a slidable connector engaging such actuator and moving therewith to engage and operate one or two switches which are likewise trapped between the contactor wall and the inside of the mounted cover, with the terminals for the such switch or switches extending out of the housing for easy electrical connection thereto. In fact, such a housing and switch assembly may be mounted on each of the two opposite side walls of the power contactor adjacent its actuator mechanism on the corresponding side, to be connectible with and operable by such mechanism. In this manner, an auxiliary unit or units of the present invention provides from one to four switches which may be mounted on a power contactor and operated mechanically as the power contactor is operated.

BRIEF DESCRIPTION OF THE DRAWINGS

FIG. 3 is an exploded view of all elements of a complete assembly of the present invention, and illustrated in the position of the optional assembly of FIG. 1 if turned 90°;

FIG. 4 is an inside view of an auxiliary switch assembly looking in the direction of the arrows along the line 4—4 of the housing of FIG. 3, but showing the assembled unit;

FIG. 5 is a detail view of the connector, power contactor actuator and a switch and its plunger, all along line 5—5 in FIG. 1; and FIG. 6 is a fragmentary detail of the projection on the inside of the assembly housing along the line 6—6 of FIG. 1 showing the bolt extending through the projection and mounting the assembly on the contactor.

DETAILED DESCRIPTION

Figure 1:
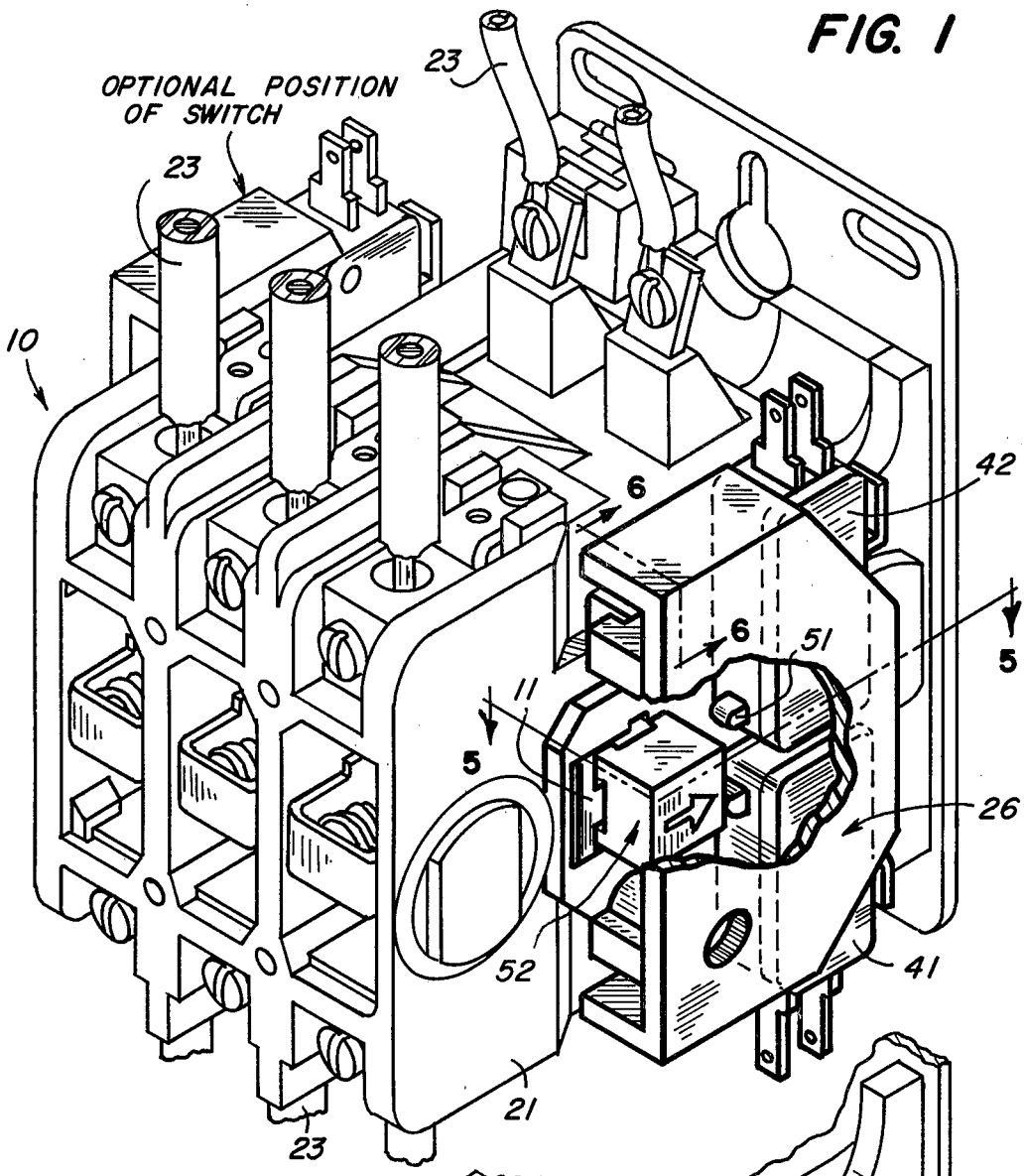
FIG. 1 is a perspective view of a power contactor with an auxiliary switch assembly mounted on the side toward the viewer and having a portion of the housing for the assembly broken away, with a second switch assembly optionally mounted on the opposite side of the contactor.
Figure 2:
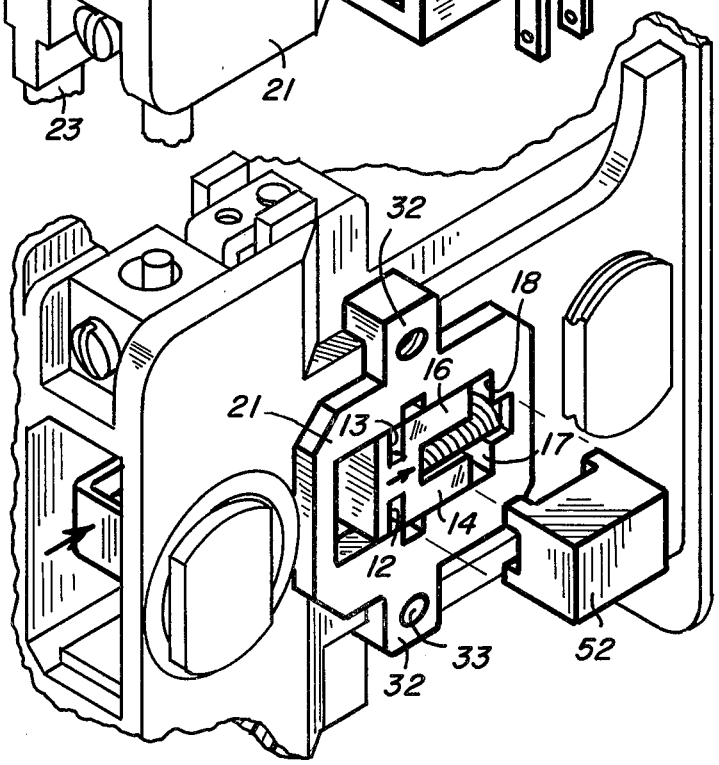
FIG. 2 is a fragmentary view of a portion of the outside of the contactor showing the contactor-actuator with the connector of the present invention displaced therefrom.

Referring now to the drawings, an EB Power Contactor manufactured by Gould, Inc. is shown as an example of such a device which has a coil and solenoid internally thereof (not shown) for operating a movable spring-biased actuator 11 in a longitudinal direction from a de-energized position in FIG. 1, to a coil-energized position in FIG. 2. The actuator has a pair of cavities or bores 12 and 13 near one end thereof, with legs 14 and 16 of a predetermined length on the actuator so that when it is in its innermost longitudinal position, there is in effect a cavity 17 and one 18 in the opening 19 in which the actuator 11 slides in the power contactor wall 21. A spring 20 (FIG. 5) biases the actuator, and a tension is built up in such spring to return the actuator to a position of rest when the solenoid is de-energized. The power contactor 10 also includes a base 22 for mounting it on a control panel or a similar structure. Insulated wires 23 connect to corresponding terminals on the power contactor 10 for the circuitry through the contactor.

The auxiliary switch assembly 26 of the present invention (FIGS. 3 and 4) includes a housing 27 that is mounted on the side wall of the power contactor 10 by two screws 28 (just one is shown in FIG. 3) that extend through bores 29 in molded projections 31 which engage corresponding portions 32 on the power contactor wall, each portion 32 having a threaded bore 33 therein to receive a screw 28. Each projection 31 has a pair of legs 34 and 36, or projecting means, which straddle a corresponding portion 32 to firmly position and maintain the housing 27 relative to the threaded bores 33 for ready assembly in the first place, and then a firm mounting when the screws 28 are fastened into those bores. In addition to the projections 31 and integral legs 34 and 36 which not only position the housing at the power contactor wall relative to the actuator 11 but space such housing away from the contactor wall, there are wall portions 37, 38 and 39 on the one-piece molded housing 27 which rest against the power contactor wall 21 and provide the space to accommodate the operating elements of the auxiliary unit. When the housing and assembly are in mounted position as shown in FIG. 1, the housing is open adjacent the contactor-actuator. The cover portion 27 with the separated wall portions at right angles thereto thus utilize the side wall of the contactor to provide the final complete housing for the switches and connector as will be described hereinafter.

Trapped or contained within the housing 27 are the auxiliary unit switches, and in the illustrated assembly, two switches 41 and 42 (FIGS. 3 and 4) are positioned by pins integral with the molded housing 27, with pins 43 extending into holes 44 in the housing for switch 41, and pins 46 in holes 47 for switch 42. Either one or two switches may be used in a unit depending upon the auxiliary circuitry to be operated, and it is further understood that a second identical auxiliary switch unit can be mounted on the opposite side of the power contactor as shown in FIG. 1. The auxiliary unit of the present invention is of such a structure that merely rotating it through 180° from the position shown in FIG. 1 around a horizontal axis, as one looks at such unit in that figure, will place all elements in the same position relative to an actuator on the opposite side of the power contactor. The upper portion of such auxiliary unit is shown on the far side in FIG. 1. The contactor structure including an actuator on that far side is identical with that fully illustrated on the near side in FIGS. 1 and 2.

One of the advantages of the complete auxiliary switch assembly is that the housing with the cover portion 27 and mounting structure as described above utilizes a standard commercial switch, a McGill 4600 Series snap-action switch manufactured by the assignee of the present patent application. In this manner, the benefit from a cost standpoint is obvious, as against a specially designed switch which would normally be of low volume manufacture and hence high cost. Although this McGill switch has excellent electrical and mechanical life characteristics, should it be necessary to replace a switch for a power contactor, that switch is readily available in inventory as a standard commercial item.

Continuing with the description; each switch has three terminals, and referring to switch 41, it has a common terminal 48, and two other terminals 49, with the possibility of hooking up that switch as well as switch 42 so that each would operate as a single pole single throw, or as a single pole double throw switch. The circuitry would be conventional for a switch of this construction, and the particular circuit which might be operated by each switch in the auxiliary unit is not a part of the present invention. Each switch also has a plunger 51, and whether one or two switches are required in the auxiliary assembly, a plunger is or the plungers are operated by a molded plastic connector 52 assembled with the actuator 11 as shown in FIGS. 1 and 5, with the complete connector 52 shown in the exploded view of FIG. 3, and spaced from the actuator in an exploded manner in FIG. 2. Such connector has four legs extending beyond the box-like body thereof, with legs 53 fitting over the ends of portions 14 and 16 of the actuator 11 (FIGS. 2 and 5) at that end of the actuator, and the legs 54 fitting into the cavities 12 and 13 near the other end of the actuator 11. This provides a tight press fit mounting for the connector 52 on the actuator (FIG. 1), which positions it so as to engage the plungers 51 on the switches. As shown in FIG. 5, the connector is trapped or contained within the housing wall portion 27 and yet is free to move longitudinally with such actuator thus illustrating the effectiveness of the housing in combination with the wall of the power contactor.

The power contactor, as has been pointed out above, is adapted for numerous electrical operations, and multiple contactors may be used where required. A normal installation would be that for a motor circuit to be energized and providing a heavy load of several hundred amperes. Within that contactor could be a coil and relay or solenoid which operates on 120 volts. An operator, or some automatic means operating a button to close a circuit would energize the coil and in turn close a relay or solenoid mechanically connected to the actuator 11. As the actuator was moved, it would correspondingly move the connector 52 to engage the switch plunger or plungers 51 and close the circuit or circuits through the switch or switches 41 and 42, if two are assembled in the unit. The coil within the contactor would remain energized to hold the actuator 11 in a closed position as shown in FIG. 2, and in turn maintain the auxiliary circuits closed. If there were two switches used in the assembly, and two auxiliary circuits provided, one switch might close a lamp circuit to show that the motor circuit was energized, and the second one might operate a meter or some other instrument to be observed during the operation of the heavy load circuit through the power contactor. Also, three or four auxiliary circuits could be accommodated for the power contactor by mounting a second auxiliary switch unit on the opposite side wall of the contactor as described above and illustrated in FIG. 1. Innumerable circuit arrangements would be possible through this structure, but the present invention is directed only to the assembly as shown in the exploded view of FIG. 3, and in an assembled view in FIG. 4, with all of the advantages resulting from a single rugged assembly, utilizing standard switches therein, low in cost, and readily mounted on the side of and mechanically connected with a power contactor device.

I claim:

1. An auxiliary electrical switch assembly adapted to be mounted on and to be operated by a power contactor, which contactor has a side wall and an actuator movable in a cavity in such wall, said assembly including an insulating housing having a cover portion and separated wall portions at right angles to said cover portion to engage said contactor side wall and space said cover portion therefrom to accommodate auxiliary electrical switch assembly elements within said space, said housing cover portion having a plurality of integral projecting portions and a plurality of integral studs on the inside thereof, with each said projecting portions having a bore extending therethrough to receive a mounting screw therein for securing said assembly to said contactor side wall and each having projecting means thereon to position said housing relative to said acutator prior to securing said assembly on said wall, with said integral studs adapted to extend through the housing on an electrical switch and position said switch in said housing and assembly, an electrical switch including a housing with bores therein adapted to receive said integral studs within said switch housing, said switch including a plunger extending out of said switch housing and a plurality of terminals, with said terminals extending out of said insulating housing between said separated wall portions, and said auxiliary assembly including a connector to be mechanically connected to said actuator at a position within the space in such insulating housing and positioned therein to engage said switch plunger upon movement of said actuator and said connector.

2. An electrical switch assembly for mounting on a power contactor structure and adapted to be mechanically operated upon operation of said power contactor structure to control auxiliary circuitry through switch means in said assembly, said assembly including a housing member which is open on one side adapted to be positioned on said power contactor structure and which has a cover portion on the other side, and which has a plurality of separated wall portions at right angles to said cover portion that space the latter away from said contactor structure when mounted thereon, a pair of electrical switches comprising said switch means, each mounted within said housing member having terminals therewith extending through said separated wall portions and available outside of said housing member, and each switch having an operating plunger extending inwardly within said space in said housing member, and a connector movable longitudinally within said housing member adapted to be operatively connected mechanically with said power contactor and positioned relative to said switch plungers so as to simultaneously engage said plungers when said connector moves upon operation of said power contactor structure.

3. In an assembly as defined in claim 2 for a power contactor structure having a side wall, wherein said housing member is a one-piece molded member which utilizes the side wall of the power contactor structure when mounted thereon to provide said space within said housing member, and wherein said cover portion and said separated wall portions with said contactor side wall house said switches and said connector.

4. In an assembly as defined in claim 2 wherein said housing member cover portion has a plurality of studs extending inwardly therefrom and each of said switches is a standard commercial snap action switch having a pair of bores therein mountable on corresponding studs within said housing and maintained rigidly thereby when said assembly is mounted on a power contactor structure.

5. In an assembly as defined in claim 2 for mounting on a power contactor structure which said structure includes therewith a spring-biased actuator in a side wall of the structure, and wherein said connector comprises a body with four integral legs thereon to connect with said actuator in a press fit and move with said actuator upon operation of said power contactor structure.

* * * * *